US005573379A

United States Patent [19]

Kimura et al.

[11] Patent Number: 5,573,379

[45] Date of Patent: Nov. 12, 1996

[54] VARIABLE CAPACITY SWASH PLATE TYPE COMPRESSOR

[75] Inventors: Kazuya Kimura; Takahiro Moroi; Kayukawa Hiroaki, all of Kariya, Japan

[73] Assignee: Kabushiki Kaisha Toyoda Jidoshokki Seisakusho, Aichi, Japan

[21] Appl. No.: 423,956

[22] Filed: Apr. 18, 1995

[30] Foreign Application Priority Data

Apr. 21, 1994 [JP] Japan ..... 6-083388

[51] Int. Cl.[6] ..... F04B 1/29

[52] U.S. Cl. ..... 417/222.2; 92/122; 417/269

[58] Field of Search ..... 417/222.1, 222.2, 417/269; 92/12.2; 91/499–505

[56] References Cited

U.S. PATENT DOCUMENTS

| | | | |
|---|---|---|---|
| 4,815,358 | 3/1989 | Smith | 92/12.2 |
| 4,836,090 | 6/1989 | Smith | 92/12.2 |
| 5,228,841 | 7/1993 | Kimura et al. | 417/222.2 |
| 5,292,233 | 3/1994 | Takenaka et al. | 417/222.2 |
| 5,316,446 | 5/1994 | Kimura et al. | 417/222.1 |
| 5,336,056 | 8/1994 | Kimura et al. | 417/222.1 |
| 5,387,091 | 2/1995 | Kawaguchi et al. | 417/222.2 |

FOREIGN PATENT DOCUMENTS 63-186973 8/1988 Japan .

*Primary Examiner*—Timothy S. Thorpe
*Assistant Examiner*—Peter G. Korytnyk
*Attorney, Agent, or Firm*—Burgess, Ryan and Wayne

[57] ABSTRACT

A variable capacity swash plate type compressor adapted to being driven by a vehicle engine without the intervention of a solenoid clutch and having a drive shaft rotating about an axis of rotation thereof, a swash plate capable of nutating to cause reciprocatory suction and compression motions of pistons in cylinder bores and of pivoting about a pivoting axis thereof to change an angle of inclination thereof with respect to a plane perpendicular to the axis of the drive shaft, the swash plate being pivotable from a 0° inclination position to a large inclination angle position by setting a product of inertia of the swash plate so that a moment is automatically generated to move the swash plate from the 0° inclination position to a large inclination angle position in response to the slowest possible rotation of the swash plate.

6 Claims, 3 Drawing Sheets

VARIABLE CAPACITY SWASH PLATE TYPE COMPRESSOR

BACKGROUND OF THE INVENTION

1. Field of the Invention

The present invention relates to a variable capacity swash plate type compressor for compressing refrigerant gas, adapted for being accommodated in a climate control system of vehicles.

2. The Description of the Related Art

Japanese Unexamined Patent Application No. 63-186973 discloses a typical variable capacity swash plate type compressor in which a housing assembly includes a cylinder block, and front and rear housings. The housing assembly defines therein a crank chamber, a suction chamber, a discharge chamber, and a plurality of cylinder bores fluidly communicated with the crank, suction, and discharge chambers. Each of the cylinder bores receives a reciprocatory piston. The housing assembly mounts therein a drive shaft so as to be rotatably supported via axially spaced a pair of anti-friction bearings. On the drive shaft a rotor or a drive plate is mounted to be rotated together with the drive shaft within the crank chamber. The rotor is provided with a guide means for smoothly guiding the pivoting motion of a swash plate, and therefore, the guide means is connected to a guided means of the swash plate at a position thereof which can be referred to as the top dead center of the swash plate. Thus, the swash plate can be rotated synchronously with the rotor about the axis of rotation of the drive shaft. The drive shaft is fitted with a sleeve element on which the swash plate is pivotally held. Namely, the swash plate is pivoted about a given axis which is perpendicular to a plane defined by the axis of rotation of the drive shaft and the top dead center of the swash plate, so as to change an angle of inclination thereof with respect to a plane perpendicular to the axis of rotation of the drive shaft. The swash plate supports thereon a wobble plate via a thrust bearing so that the wobble plate is prevented by a rotation-preventing means from being rotated with the swash plate. The wobble plate is engaged with one end of each of a plurality of piston rods having the other ends thereof connected to the reciprocatory pistons. The wobble plate and respective piston rods acts as a mechanism for converting the rotating motion of the swash plate to the reciprocating motion of the respective pistons in the cylinder bores.

The housing assembly is also provided with a capacity control valve housed in a portion thereof, which can detect the suction pressure of a refrigerant gas and can introduce the compressed refrigerant gas at a discharge pressure into the crank chamber.

When the drive shaft is rotated by a drive force transmitted from e.g., a vehicle engine via a solenoid clutch device, the swash plate at a given angle of inclination is rotated together with the drive shaft. Thus, the rotation of the swash plate is converted by the wobble plate and the piston rods into the reciprocation of the pistons in the respective cylinder bores. Therefore, the refrigerant gas is sucked from the suction chamber into the cylinder bores where the refrigerant gas is compressed. When the refrigerant gas is compressed in the respective cylinder bores, it is discharged toward the discharge chamber.

During the compressing operation of the compressor, when the suction pressure of the refrigerant gas decreases, the capacity control valve detects a reduction in the suction pressure, and permits the compressed refrigerant gas to flow from the discharge chamber into the crank chamber thereby causing an increase in the pressure level within the crank chamber. An increase in the pressure level in the crank chamber causes an increase in a back pressure acting on the respective pistons so as to decrease the reciprocating stroke of the respective pistons. Thus, the angle of inclination of the swash plate is reduced, and the discharge capacity of the compressor reduces.

On the contrary, when the suction pressure of the refrigerant gas increases, the capacity control valve stops passing the compressed refrigerant gas at a discharge pressure from the discharge chamber into the crank chamber, and accordingly, the pressure level in the crank chamber is reduced so as to reduce the back pressure applied to the respective pistons. Thus, the reciprocating stroke of respective pistons increases causing an increase in the angle of inclination of the swash plate. Therefore, the discharge capacity of the compressor increases.

When the angle of inclination of the swash plate of the above-described compressor increases and the swash plate comes into abutment against the rotor, the angle of inclination of the swash plate stops increasing.

On the contrary, when the angle of inclination of the swash plate decreases and the swash plate comes into abutment against a circlip element or a washer element fixedly mounted on the drive shaft, the washer element stops the angle of inclination of the swash plate decreasing. The smallest angle of inclination of the swash plate is generally set at angle larger than 0 degree, i.e., at several degrees so that the smallest capacity of the compressor may be approximately 10%.

Nevertheless, when the above-described refrigerant compressor is supplied with a drive force by the vehicle engine via the solenoid clutch so as to rotate the drive shaft, the compressor compresses the refrigerant to exhibit at least a small discharge capacity even when the thermal load applied to the compressor, and the suction pressure of the refrigerant gas, are very small. Therefore, the capacity control valve constantly detects the suction pressure and acts to introduce the compressed refrigerant gas, at a given discharge pressure, into the crank case. Thus, when the rotational speed of the drive shaft of the compressor is high, the pressure level in the crank chamber instantly increases, resulting in an adverse affect on the sealing performance of a shaft sealing device mounted on the drive shaft.

Taking into account this adverse affect, if the compressor is assembled so as to have a swash plate thereof set in such a manner that the smallest angle of inclination of the swash plate is 0° without any consideration of the shape and the center of gravity of the swash plate, the compressor can neither exhibit compression performance under a particular condition such that pressure in the crank chamber is balanced with the suction pressure, nor return to a high capacity operation from the smallest discharge capacity operation (i.e., capacity at 0%) under the conditions of a low thermal load and a high rotating speed of the drive shaft.

Further, when the solenoid clutch is disengaged so as to stop transmission of the drive force from the vehicle engine to the drive shaft of the compressor, a driver of the vehicle must often have an uncomfortable feeling when the solenoid clutch is engaged. In addition, mounting of the solenoid clutch on the vehicle to control the transmission of the drive force from the vehicle engine to the refrigerant compressor contributes to an increase in the weight of vehicle per se, an increase in an electric power consumption, and a deterioration of fuel consumption of the vehicle.

SUMMARY OF THE INVENTION

Therefore, one object of the present invention is to provide a variable capacity swash plate-operated refrigerant compressor provided with means for setting the smallest angle of inclination of a swash plate at 0°, and being capable of certainly restoring the swash plate from the state of the smallest angle of inclination thereof to a different state of a larger angle of inclination whereby the reliability and durability of a shaft seal device mounted on the drive shaft can be increased.

A second object of the present invention is to provide a variable capacity swash plate-operated refrigerant compressor accommodated in a climate control system or an air-conditioning system of a vehicle and capable of being connected to a vehicle engine without using a solenoid clutch.

In accordance with the present invention, there is provided a variable capacity swash plate type refrigerant compressor including:

a housing assembly having a cylinder block, a front housing, and a rear housing; the housing assembly defining therein a suction chamber, a discharge chamber, a crank chamber, and a plurality of cylinder bores;

a plurality of reciprocatory pistons received in the plurality of cylinder bores;

a drive shaft supported in the housing assembly so as to rotate about an axis of rotation thereof upon receipt of a drive force;

a rotor mounted on the drive shaft so as to be rotated together in the crank chamber, the rotor having a guide means disposed in the crank chamber;

a swash plate arranged around the drive shaft in the crank chamber and having a guided means engaged with the guide means of the rotor at a position corresponding to a top dead center of the swash plate so as to be rotated together with the rotor to thereby perform a nutating motion, the swash plate being disposed to be pivoted about a pivoting axis to thereby change an angle of inclination thereof from a plane perpendicular to the axis of rotation of the drive shaft, the pivoting axis of the swash plate being perpendicular to a plane which is defined by the axis of rotation of the drive shaft and the top dead center of the swash plate;

a connecting means for connecting the swash plate to the respective pistons within the crank chamber so that the nutating motion of the swash plate is converted into reciprocating motion of the respective pistons; and a control means for controlling the angle of inclination of the swash plate by adjustably changing a pressure level in the crank chamber to thereby change the capacity of the compressor, wherein the compressor comprises:

means for setting an extent of change in an angle of inclination of the swash plate in such a manner that the swash plate can be pivoted to a 0° inclination position thereof; and means for setting a product of inertia of the swash plate with regard to a rectangular coordinate system having an origin positioned at the intersection of the axis of rotation of the drive shaft and a plane which is perpendicular to the axis of rotation of the drive shaft and contains therein the pivoting axis of the swash plate, and one of the perpendicular axes thereof corresponding to the axis of rotation of the drive shaft, the setting of the product of inertia being performed in such a manner that when the angle of inclination of the swash plate is 0°, a moment is generated to increase the angle of inclination of the swash plate to thereby increase the capacity of the compressor in response to rotation of the swash plate.

Since the guided means of the swash plate is engaged with the guiding means of the rotor, the swash plate rotates together with the rotor and pivots about the pivoting axis so as to change the angle of inclination. The product of inertia of the swash plate is determined by the shape, the position of the center of gravity, and the mass of the swash plate.

Preferably, the swash plate of the above-described compressor is constantly urged by a spring means so as to reduce the angle of inclination thereof, and the swash plate has a product of inertia thereof which is set so as to overcome the spring force even when the swash plate is rotated at the slowest possible speed.

When the compressor is started in a state such that the swash plate has an inclination of approximately 0°, since the product of inertia of the swash plate is set so as to produce a moment by which the angle of inclination of the rotating swash plate gradually increases from an inclination of 0° to a larger inclination, the compressor can begin to carry out suction and compression operations, so that a pressure differential is generated between the suction and discharge pressures of the compressor.

When the swash plate of the compressor moves from the 0° inclination position to a larger angle of inclination, the compressor can immediately perform an ordinary operation for sucking, compressing, and discharging the refrigerant gas by adjustably changing the angle of inclination of the swash plate in response to a change in the pressure level within the crank chamber which is controlled by a capacity control valve.

In the refrigerant compressor, according to the present invention, accommodated in a climate control system or an air-conditioning system, when the amount of the refrigerant gas circulating through the system is reduced due to a reduction in a thermal load, it is possible to control the operation of the compressor so that the discharge capacity of the compressor is reduced to approximately zero %. Therefore, the capacity control valve of the compressor can operate so as to achieve an optimal control of a pressure level in the crank chamber to thereby respond to a requirement of any small reduction in the thermal load and to a requirement of any slight increase in the rotating speed. Namely, it is possible to prevent the pressure level in the crank chamber from becoming unnecessary high. Accordingly, the shaft sealing device of the compressor is not adversely affected by the pressure in the crank chamber, and can be reliable and durable over a long operational life.

Further, if the compressor according to the present invention is uninterruptedly operated by the supply of a driving force to the drive shaft, the durability of the shaft seal device of the compressor is not adversely affected by the continuous rotation of the drive shaft, and the discharge capacity of the compressor can be certainly restored to a larger capacity state. Therefore, it is possible to omit a solenoid clutch to transmit a driving force from the vehicle engine to the drive shaft of the compressor.

Moreover, when the compressor is provided with the spring means for constantly urging the swash plate toward the smallest inclination position thereof, the compressor can always start operating from the state where the swash plate is set at an inclination of 0°. Thus, starting of the operation of the compressor does not provide any sudden increase in a load applied to the vehicle engine, and accordingly, a driver of the vehicle does not feel a disturbance.

BRIEF DESCRIPTION OF THE DRAWINGS

The above and other objects, features and advantages of the present invention will be made more apparent from the ensuing description of preferred embodiments thereof in conjunction with the accompanying drawings wherein.

DESCRIPTION OF THE PREFERRED EMBODIMENTS

Figure 1:
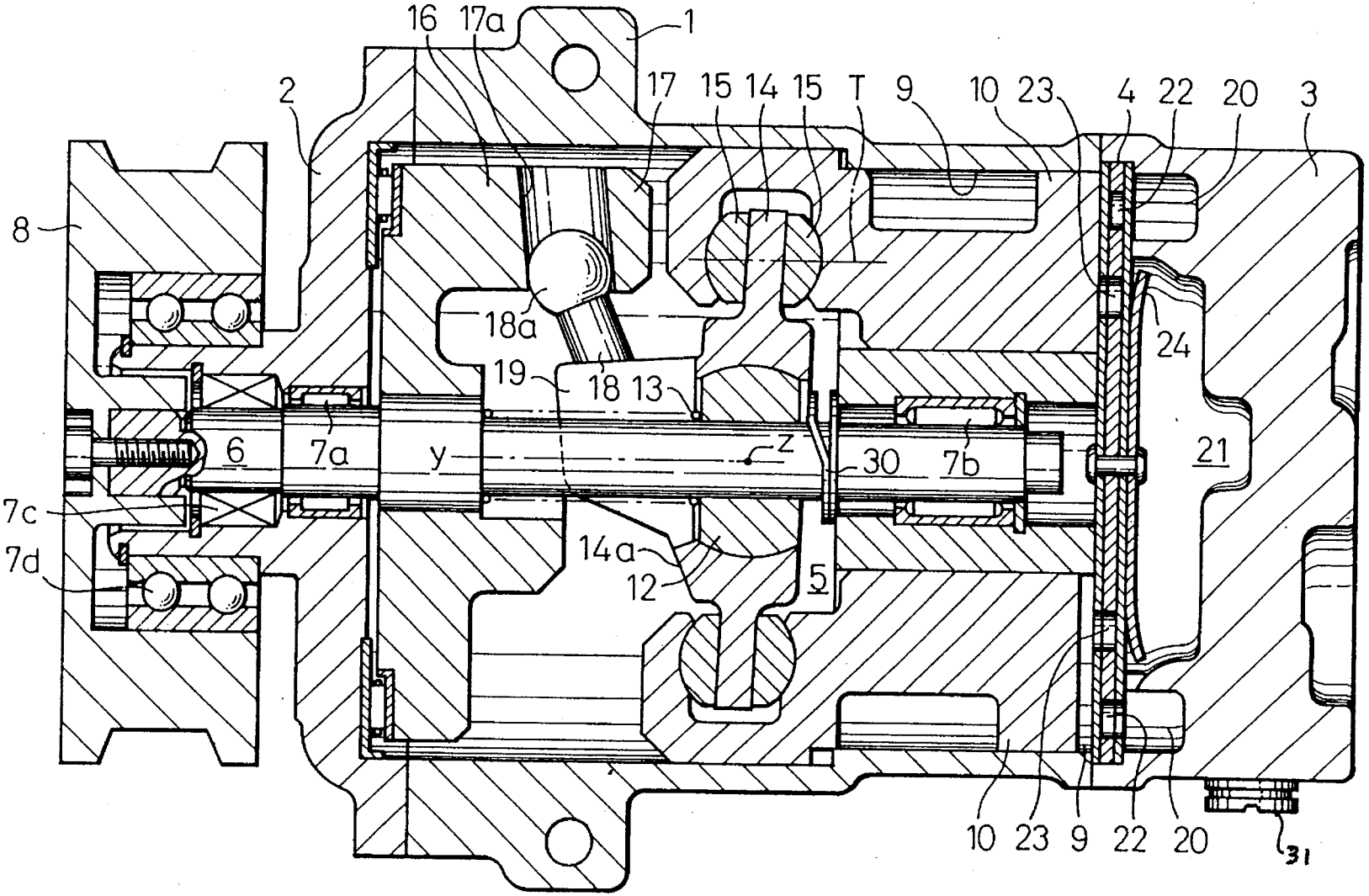
FIG. 1 is a longitudinal cross-sectional view of a variable capacity swash plate operated refrigerant compressor according to an embodiment of the present invention.

Referring to FIG. 1, the variable capacity swash-plate-operated refrigerant compressor according to the present invention is provided with an housing assembly receiving therein a refrigerant compressing mechanism. Namely, the housing assembly of the compressor includes a cylinder block 1, a front housing 2 sealingly connected to a front end of the cylinder block 1, and a rear housing 3 sealingly connected to a rear end of the cylinder block 1 via a valve plate 4. The cylinder block 1 and the front housing 2 define a crank chamber 5 in which a drive shaft 6 is received, and supported, by a pair of anti-friction bearings 7*a* and 7*b* so as to be rotated about an axis extending through the center of both bearings 7*a* and 7*b*. The front end of the drive shaft 6 extends outward over a boss portion of the front housing 2 via a shaft seal unit 7*c* housed in the boss portion, and the front extreme end of the drive shaft 6 is supported by another anti-friction bearing 7*d* fitted in the boss portion of the front housing 2, and is connected to a pulley 8.

The cylinder block 1 of the housing assembly is provided with a plurality of axial cylinder bores 9 arranged around the axis of rotation of the drive shaft 6, and the respective cylinder bores 9 receive pistons 10.

A rotor 16 is mounted on a portion of the drive shaft 6 so as to be rotated together with the drive shaft 6 in the crank chamber 5. On the drive shaft 6 is axially slidably mounted a sleeve element 12 having a spherical outer surface on which a later-described swash plate is mounted. A spring 13 is mounted around the drive shaft 6 and arranged between the rotor 16 and the sleeve element 12 so as to constantly urge the sleeve element 12 toward the rear housing 3.

A swash plate 14 is mounted on the outer spherical surface of the sleeve element 12, and therefore, the swash plate 14 can perform a pivoting motion about a later-described pivotal axis over a predetermined angle Θ, and a later-described rotation about the axis of rotation of the drive shaft 16 to thereby implement a nutating motion causing reciprocation of the pistons 10 in the respective cylinder bores 9.

In the compressor of the present embodiment as shown FIG. 1, the pivotal axis is designated by "Z" and is arranged to be perpendicular to the axis of rotation of the drive shaft 6. Thus, the swash plate 14 pivots about the axis "Z" to change an angle of inclination thereof with respect to a plane perpendicular to the axis of rotation of the drive shaft.

The rotor 16 is provided with a pair of support arms 17, 17 protruding rearward from a base portion thereof supported by a thrust bearing mounted on an inner face of the front housing 2. The support arms 17, 17 are formed so as to provide a guide for the pivotal motion of the swash plate 14. Namely, the guide of the support arms 17,17 of the rotor 16 includes a pair of linearly extending cylindrical through-bores 17*a*, 17*a* formed in end portions of the support arms 17, 17. The cylindrical through-bores 17*a*, 17*a* run parallel to a plane defined by the axis of rotation of the drive shaft 6 and the top dead position "T" of the swash plate 14 in the nutating motion thereof, and are directed toward the axis of the rotation of the drive shaft 6. The central axis of each of the respective cylindrical through-bores 17*a*, 17*a* is arranged so that the top dead center of respective pistons 10 in the reciprocating motion thereof is unchanged notwithstanding a change in the angle of inclination of the swash plate 14. It should be noted that the cross-section of each cylindrical through-bore 17*a* is a true circle.

A plurality of pairs of shoes 15, 15 are arranged at a plurality of positions in the peripheral portion of the swash plate 14. Each shoe 15 is provided with a flat face in contact with the swash plate 14, and a spherical outer face slidably received in a spherical recess of each piston 10. Thus, the swash plate 14 is engaged with each of the pistons 10 via the pair of shoes 15,15, and therefore, the nutating motion of the swash plate 14 causes a reciprocating motion of the respective pistons 10 in the respective cylinder bores 9.

The swash plate 14 is provided with a pair of brackets 19, 19 on the front side thereof. The brackets 19, 19 are circumferentially arranged at positions symmetrical with respect to the drive shaft 6, and also with respect to the top dead center of the swash plate 14. Each of the brackets 19 is connected to an end of a guide pin 18, and the other end of the guide pin 18 is fixedly connected to a ball element 18*a*. The ball elements 18*a*, 18*a* of the pair of guide pins 18 are slidably and rotatably engaged in the cylindrical through-bores 17*a*, 17*a* of the support arms 17. The swash plate 14 is also provided with an inclined partial face 14*a* at a portion thereof, which is formed as a stop engageable with a portion of the rotor 16. Namely, when the inclined partial face 14*a* is engaged with the rotor 16, it stops and limits the pivoting motion of the swash plate 14 around the aforementioned pivoting axis to thereby define, the maximum angle $\Theta_{max}$ of inclination of the swash plate 14.

The minimum angle of inclination, i.e., a 0° inclination of the swash plate 14 is defined by abutment of the sleeve element 12 against a mechanical stop, i.e., a circlip element 30 arranged adjacent to a rear end of the drive shaft 6.

At this stage, the swash plate 14 including the above-mentioned pair of brackets 19, the guide pins 18, and the ball elements 18*a* is designed so as to always obtain an operational condition such that when the swash plate 14 starts its rotation from the 0° inclination condition thereof, a moment is automatically generated in the rotating swash plate 14 to thereby increase its inclination angle to a larger inclination angle by overcoming the force of the spring 13. In order to achieve this, the product of inertia of the swash plate 14 with regard to a rectangular coordinate system having perpendicular axes one of which coincides with the axis of rotation of the drive shaft 6, and the origin "O" located at a point where a plane containing therein the pivoting axis of the swash plate 14 and extending perpendicularly to the axis of rotation of the drive shaft 6 intersects the latter axis is determined so as to generate the above-mentioned moment by properly designing the shape of the swash plate, the location of the center of gravity "G" of the swash plate 14 with respect to the above-mentioned origin "O", and the mass of the swash plate 14.

The rear housing 3 of the compressor is provided with a suction chamber 20 and a discharge chamber 21 formed therein. The suction chamber 20 is fluidly connected to an evaporator in the air-conditioning system, and the discharge chamber 21 is fluidly connected to a condenser in the air-conditioning system. The valve plate 4 is provided with a plurality of suction ports 22 and a plurality of discharge ports 23 formed therein so as to be in registration with the cylinder bores 9. Namely, the compression chambers defined in the respective cylinder bores 9 between the ends of the respective pistons 10 and the valve plate 4 can be communicated with the suction chamber 20 via the suction ports 22 and with the discharge chambers 21 via the discharge ports 23. The suction ports 22 of the valve plate 4 are covered by suction valves which are moved between closed and opened positions thereof in response to the reciprocation of the pistons 10. Similarly, the discharge ports of the valve plate 4 are covered by discharge valves which are moved between closed and opened positions thereof in response to the reciprocation of the pistons 10. Further, the rear housing 3 receives a capacity control valve 31 arranged so as to detect the suction pressure of a refrigerant gas and to control the pressure prevailing in the crank chamber 5.

In the compressor having the above-described internal construction, when a drive force is applied to the drive shaft 6 by the vehicle engine via a belt and pulley 8, the drive shaft 6 rotates together with the rotor 16 and the swash plate 14. Therefore, the rotation of the swash plate 14 generates the nutating motion thereof which causes the reciprocation of the pistons 10 in the cylinder bores 9 via the shoes 15. The reciprocation of the pistons 10 causes the refrigerant gas to be sucked from the suction chamber 20 into the compression chambers of the respective cylinder bores 9 and to be compressed by the pistons 10. After compression, the compressed refrigerant gas is discharged from the respective cylinder bores 9 into the discharge chamber 21. The discharge amount of the compressed refrigerant gas is always regulated by the pressure level prevailing in the crank chamber 5, which is controlled by the capacity control valve. Namely, when the suction pressure increases in response to an increase in a thermal load, the capacity control valve detects the increasing suction pressure and reduces the amount of flow of the refrigerant gas at high pressure from the discharge chamber 21 toward the crank chamber 5. Thus, the pressure level in the crank chamber 5 falls so as to reduce the back pressure acting on the respective pistons 10. Accordingly, the reciprocation stroke of the respective pistons is increased while causing the pivoting motion of the swash plate 14 to increase from the angle of inclination Θ. During the pivoting of the swash plate 14, the ball elements 18*a* of the guide pins 18 smoothly and slidably move inside the cylindrical bores 17*a* so as to move away from the drive shaft 6. The pivoting motion of the swash plate 14, which increases the angle of inclination thereof, moves the sleeve element 12 toward the front of the compressor and thus compresses the spring 13.

On the contrary, when the thermal load decreases, the suction pressure reduces. Therefore, the capacity control valve detects the reduction in the suction pressure, and permits a sufficient amount of the refrigerant gas at high pressure to flow from the discharge chamber 21 toward the crank chamber 5. Accordingly, the pressure level in the crank chamber 5 increases to thereby increase the back pressure acting on the respective pistons 10. Thus, the reciprocation stroke of the respective pistons 10 is reduced while causing the pivotal motion of the swash plate 14 about the pivoting axis "Z" to reduce the angle of inclination Θ of the swash plate 14 and thus to reduce the discharge capacity of the compressor. During the pivotal motion of the swash plate 14, the ball elements 18*a* of the support arms 19 smoothly and slidably move inside of the cylindrical bores 17*a* of the guides 17 and approach the drive shaft 6.

The pivotal motion of the swash plate 14 in the direction which reduces the angle of inclination Θ thereof toward an inclination of 0° is promoted by the spring 13.

When the vehicle engine stops, and when a substantial time has lapsed after the stopping of the engine to establish a balanced condition among the pressures in the crank chamber 5, the suction chamber 20, the discharge chamber 21, and the fluid circuit of the air-conditioning or climate control system, the angle of inclination Θ of the swash plate 14 falls to 0° due to the force of the spring 13 toward the 0° inclination position, and stays there. Namely, it is ensured that the compressor can be started with the swash plate in the 0° inclination position. Accordingly, no appreciable load is applied to the vehicle engine at the start of the compressor.

When the compressor starts and the swash plate 14 commences rotation thereof at the 0° inclination position, the angle of inclination Θ of the swash plate 14 is gradually increased, by a moment generated by the product of inertia designed into the swash plate 14, from the 0° inclination to a larger angle of inclination Θo. Thus, the suction and compression operation of the compressor are initiated so as to generate pressure differentials between the pressures in the crank chamber 5, the suction chamber 20, and the discharge chamber 21. Therefore, the pressure differential restores the swash plate 14 to an inclination position suitable for producing the discharge capacity required by a thermal load. Thereafter, the compressor operates in the same manner as the conventional variable capacity swash plate type refrigerant compressor.

In accordance with the present invention, the compressor can reduce its discharge capacity to nearly 0% of its maximum capacity, depending on a reduction in an amount of the refrigerant circulated, which is in turn caused by reduction in the thermal load. Accordingly, the compressor can operate so as to certainly comply with the requirement of the capacity control valve which controls the discharge capacity of the compressor according to a change in the thermal load (from substantially 0% to a predetermined large load), and to a wide range of speeds (from high speed to substantially zero) of the rotation of the compressor. Namely, since the compressor can have a 0° inclination position of the swash plate 14 due to the spring 13 constantly urging the swash plate 14 and the sleeve element 12 toward the rear side, the pressure prevailing in the crank chamber 5 can be prevented from increasing to a very high pressure. Therefore, it is ensured that the shaft seal device 7*c* is not subjected to an unexpectedly high pressure and accordingly, the durability of the device can be extended.

Further, according to the present invention, although the compressor is continuously supplied with a drive force from the vehicle engine via the pulley 8, the durability of the shaft seal device 7*c* is not deteriorated. Moreover, the discharge capacity of the compressor can be certainly restored from the 0% capacity state to a desired discharge capacity state. Accordingly, it is possible to omit a solenoid clutch for transmitting of the drive force from the vehicle engine to the compressor.

A description of how the angle of inclination Θ of the swash plate 14 of the compressor according to the present invention is generated by the product of inertia thereof from the inclination of 0° to a larger angle inclination (angle Θo) will now be provided hereinbelow with reference to FIGS. 2 through 4.

Figure 2:
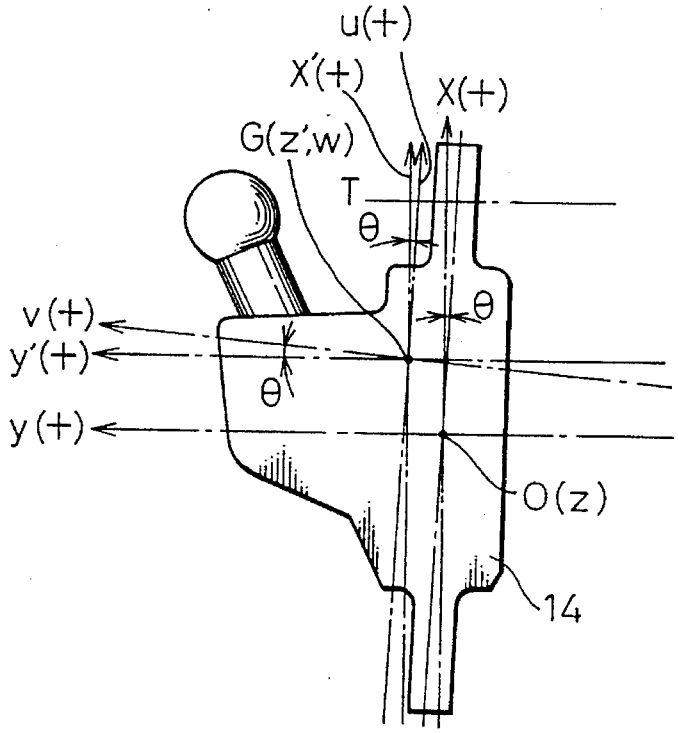
FIG. 2 is a partial side view of a swash plate accommodated in the compressor according to the present invention, illustrating the relationship between the swash plate and its rectangular coordinates.
Figure 3:
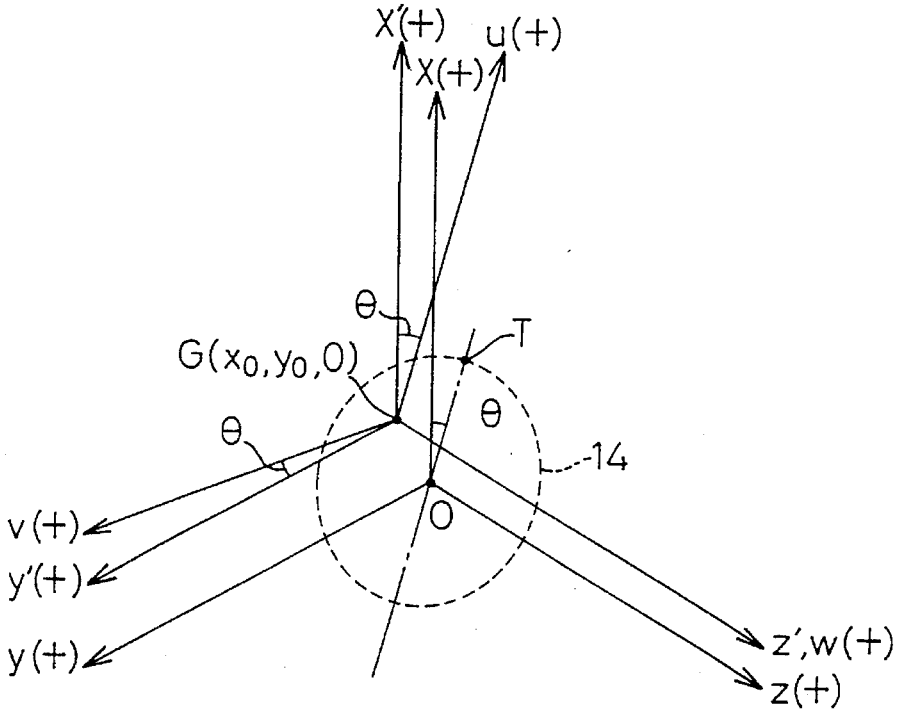
FIG. 3 is a graphical view illustrating several rectangular coordinate systems for analyzing the operation of the swash plate accommodated in the compressor of the present invention; and, FIG. 4 is a graph illustrating the relationship between the angle of inclination of the swash plate and a magnitude of the moment acting on the swash plate.

As shown in FIGS. 2 and 3, three rectangular coordinate systems (x,y,z; x', y', z'; u, v, w) are defined.

The first coordinate system O(x,y, z) is defined as a rectangular coordinate system having its origin located at a position O where a plane containing therein the pivoting axis of the swash plate 14 and extending perpendicularly to the axis of rotation of the drive shaft 6 intersects the axis of rotation of the drive shaft 6. The y-axis of the first rectangular coordinate system is parallel with the axis of rotation of the drive shaft 6, and the z-axis is parallel with the pivoting axis of the swash plate 14, and the x-axis is perpendicular to both the x-, and y-axes. It should be noted that the positive region of the y-axis extends through the front half of the compressor, that the positive region of the z-axis extends through an internal region of the compressor in which compression of the refrigerant is carried out due to clockwise rotation of the swash plate 14 viewing from the front face of the compressor, and that the positive region of the x-axis extends through a portion of the swash plate 14, which includes the top dead center of the swash plate 14. In the described embodiment, the y-axis of the rectangular coordinate system O coincides with the axis of rotation of the drive shaft 6, and therefore, the top dead center "T" of the swash plate 14 lies in a plane defined by the x- and y-axes. Further, the z-axis coincides with the pivoting axis of the swash plate 14.

A second rectangular coordinate system G (x', y', z') is defined as a rectangular coordinate system having its origin at a position coinciding with the center of gravity G of the swash plate 14. The x'-, y'-, and z'- axes of the second rectangular coordinate system G are parallel with and have the same directions with the x-, y-, and z-axes of the first rectangular coordinate system, respectively.

A third rectangular coordinate system G (u,v, w) is defined as a rectangular coordinate system having the origin at a position coinciding with the center of gravity G of the swash plate 14. The v-axis extends perpendicularly to the face of the swash plate 14, and the w-axis extends in parallel with the z'-axis of the second rectangular coordinate system. The u-axis extends perpendicularly to the v-, and w-axes. The second and third coordinate systems G are arranged so as to have a relationship as set forth below.

Namely, an angle between the v-axis of the third coordinate system and the y'-axis of the second coordinate system, and a different angle between the u-axis of the third coordinate system and the x'-axis of the second coordinate system are equal to an angle Θ of inclination of the swash plate 14. Further, the w-axis of the third coordinate system constantly coincides with the z'-axis of the second coordinate system. Thus, when the angle Θ of inclination of the swash plate 14 is 0° the three orthogonal u-, v-, and w-axes of the third coordinate system completely coincide with the three orthogonal x'-, y'-, and z'-axes of the second coordinate system.

On the basis of the above-mentioned three rectangular coordinate systems, a moment of inertia $I_u$ of the swash plate 14 with respect to the above-mentioned u-axis, a moment of inertia $I_v$ of the swash plate 14 with respect to the v-axis, and a moment of inertia $I_w$ of the swash plate 14 with respect to the w-axis are defined by the equations as set forth below.

$$I_u=\int(V^2+W^2)dm \quad (1)$$

$$Iv=\int(w^2+u^2)dm \quad (2)$$

$$I_w=\int(u^2+v^2)dm \quad (3)$$

In the above equations (1) through (3), m indicates a mass of the swash plate 14, and dm indicates the mass of each of the micro elements which constitute the swash plate 14.

The product of inertia $P_{uv}$ of the swash plate 14 with respect to the u-axis and the v-axis, the product of inertia $P_{vw}$ of the swash plate 14 with respect to the v-axis and the w-axis, and the product of inertia $P_{wu}$ of the swash plate 14 with respect to the w-axis and the u-axis are defined by the equations as set forth below.

$$P_{uv}=\int uvdm \quad (4)$$

$$P_{vw}=\int vwdm=0 \quad (5)$$

$$P_{wu}=\int wudm=0 \quad (6)$$

In the above equations, it should be understood that since the swash plate 14 is shaped to be symmetrical with respect to a plane defined by the u-axis and the v-axis, $P_{vw}=0$, and $P_{wu}=0$ are established.

Further, the moment of inertia $I_{x'}$ of the swash plate 14 with respect to the x'-axis, the moment of inertia $I_{y'}$ of the swash plate 14 with respect to the y'-axis, and the moment of inertia $I_{z'}$ of the swash plate 14 with respect to the z'-axis can be defined by the equations as set forth below.

$$I_x=\int(y'^2+z'^2)dm \quad (7)$$

$$I_y=\int(z'^2+x'^2)dm \quad (8)$$

$$I_z=\int(x'^2+y'^2)dm \quad (9)$$

The product of inertia $P_{x'y'}$ of the swash plate 14 with respect to the x'-axis and the y'-axis, the product of inertia $P_{y'z'}$ of the swash plate 14 with respect to the y'-axis and the z'-axis, and the product of inertia $P_{z'x'}$ of the swash plate 14 with respect to the z'-axis and the x'-axis are defined by the equations as set forth below.

$$P_{x'y}=\int x'y'dm \quad (10)$$

$$P_{y'z}=\int y'z'dm \quad (11)$$

$$P_{z'x}=\int z'x'dm \quad (12)$$

Further, in the two rectangular coordinate systems G (x', y', z') and G (u,v,w), there is an angular shift "Θ" between the u-axis and the x'-axis, and between the v-axis and the y'-axis. Thus, the equations (13) through (15) below can be obtained.

$$x'=u\cos\Theta+v\sin\Theta \quad (13)$$

$$y'=-u\sin\Theta+v\cos\Theta \quad (14)$$

$$z'=w \quad (15)$$

The equation (7) can be transformed into the equation (16) as set forth below, by using the above equations (14) and (15) .

$$\begin{aligned} I_{x'} &= \int\{(-u\sin\theta+v\cos\theta)^2+w^2\}\,dm \quad (16)\\ &= \int(u^2\sin^2\theta+v^2\cos^2\theta-2uv\sin\theta\cos\theta+w^2)\,dm \end{aligned}$$

In the equation (16), since $w^2=w^2(\sin^2\Theta+\cos^2\Theta)$, the equation (16) can be changed to the equation (17) below.

$$I_{x'} = \int (v^2\cos^2\theta + w^2\cos^2\theta + w^2\sin^2\theta + u^2\sin^2\theta - 2uv\sin\theta\cos\theta)\,dm = \int (v^2+w^2)\cos^2\theta\,dm + \int (w^2+u^2)\sin^2\theta\,dm - 2\int uv\sin\theta\cos\theta\,dm \quad (17)$$

At this stage, from the afore-mentioned equation (1), $\int(v^2+w^2)\,dm=I_u$, from the afore-mentioned equation (2), $\int(w^2+u^2)\,dm=Iv$, and from the afore-mentioned equation (4), $\int uvdm=P_{uv}$. Thus, the equation (17) can be expressed by the equation (18) as set forth below.

$$I_x=I_u\cos^2\Theta+Iv\sin^2\Theta-2P_{uv}\sin\Theta\cos\Theta \quad (18)$$

Further, the equation (8) can be transformed into the equation (19) as set forth below by using the afore-mentioned equations (13) and (15).

$$I_{y'} = \int \{w^2+(u\cos\theta+v\sin\theta)^2\}\,dm = \int (w^2+u^2\cos^2\theta+v^2\sin^2\theta+2uv\sin\theta\cos\theta)\,dm \quad (19)$$

If it is assumed that $\sin^2\Theta+\cos^2\Theta=1$, then $w^2=w^2(\sin^2\Theta+\cos^2\Theta)$ and the above equation (19) can be transformed into the equation (20) as set forth below.

$$I_{y'} = \int (v^2\sin^2\theta+w^2\sin^2\theta+w^2\cos^2\theta+u^2\cos^2\theta+2uv\sin\theta\cos\theta)\,dm = \int (v^2+w^2)\sin^2\theta\,dm + \int (w^2+u^2)\cos^2\theta\,dm + 2\int uv\sin\theta\cos\theta\,dm \quad (20)$$

Since $\int(v^2+w^2)\,dm$ is equal to $I_u$ by taking the afore-equation (1) into consideration, and since $\int(w^2+u^2)\,dm$ is equal to $I_v$ by taking the equation (2) into consideration, and $\int uvdm$ is equal to $P_{uv}$ by taking the equation (4) into consideration, the above equation (20) can be transformed into the equation (21) as shown below.

$$I_y=I_u\sin^2\Theta+I_v\cos^2\Theta+2P_{uv}\sin\Theta\cos\Theta \quad (21)$$

Further, the afore-described equation (9) can be transformed into the equation (22) as set forth below by introducing the afore-described equations (14) and (15) into that equation (9).

$$I_{z'} = \int \{(u\cos\theta+v\sin\theta)^2+(-u\sin\theta+v\cos\theta)^2\}\,dm = \int (u^2\cos^2\theta+v^2\sin^2\theta+2uv\sin\theta\cos\theta+u^2\sin^2\theta+v^2\cos^2\theta-2uv\sin\theta\cos\theta)\,dm = \int (u^2+V^2)\,dm \quad (22)$$

At this stage, from the afore-described equation (3), $\int(u^2+v^2)\,dm$ is equal to $I_w$. Therefore, the above equation can be transformed into the equation (23) as set forth below.

$$I_z=I_w \quad (23)$$

Moreover, when the afore-mentioned equation (10) can be transformed into the equation (24) below by introducing the afore-described equations (13) and (14) into the equation (10).

$$P_{x'y'} = \int \{(u\cos\theta+v\sin\theta)\ (-u\sin\theta+v\cos\theta)^2\}\,dm = \int (-u^2\sin\theta\cos\theta+uv\cos^2\theta-uv\sin^2\theta+v^2\sin\theta\cos\theta)\,dm = (\cos^2\theta-\sin^2\theta)\int uvdm + \int \{v^2\sin\theta\cos\theta+w^2\sin\theta\cos\theta-(w^2\sin\theta\cos\theta+u^2\sin\theta\cos\theta)\}\,dm = (\cos^2\theta-\sin^2\theta)\int uvdm + \int \{(v^2+w^2)\sin\theta\cos\theta-(w^2+u^2)\sin\theta\cos\theta\}\,dm \quad (24)$$

At this stage, $\int uvdm$ is equal to $P_{uv}$ on the basis of the afore-described equation (4), $\int(v^2+w^2)dm$ is equal to $I_u$ on the basis of the equation (1), and $\int(w^2+u^2)\,dm$ is equal to $I_v$ on the basis of the equation (2). Therefore, the above equation (24) can be further transformed into the equation (25) as set forth below.

$$P_{x'y'}=P_{uv}(\cos^2\Theta-\sin^2\Theta)+(I_u-I_v)\sin\Theta\cos\Theta \quad (25)$$

Further, the afore-mentioned equation (11) can be transformed into the equation (26) shown below by introducing the equations (14) and (15) into the equation (11).

$$P_{y'z'} = \int (-u\sin\theta+v\cos\theta)\,wdm = -\sin\theta\int uwdm + \cos\theta\int vwdm \quad (26)$$

At this stage, from the afore-mentioned equation (6), it can be stated that $\int wudm$ is equal to $P_{wu}$, and from the afore-described equation (5), it can be stated that $\int vwdm$ is equal to $P_{vw}$. Therefore, the equation (26) can be further transformed into the equation (27) as set forth below.

$$P_{y'z'}=-P_{wu}\sin\Theta+P_{vw}\cos\Theta \quad (27)$$

From the equations (5) and (6), it can be stated that $P_{wu}=P_{vw}=0$. Thus, the equation (27) can be changed into the equation (28) as set forth below.

$$P_{y'z'}=0 \quad (28)$$

The equation (12) can be transformed into the equation (29) as set forth below by introducing the afore-described equations (13) and (15) into the equation (12).

$$P_{z'x'} = \int w(u\cos\theta+v\sin\theta)\,dm = \cos\theta\int wu\,dm + \sin\theta\int vw\,dm \quad (29)$$

At this stage, since $\int wudm$ is equal to $P_{wu}$ by taking the equation (6) into consideration, and $\int vwdm$ is equal to $P_{vw}$ by taking the equation (5) into consideration, the above equation (29) can be rewritten as the equation (30) as set forth below.

$$P_{z'x'}=P_{wu}\cos\Theta+P_{vw}\sin\Theta \quad (30)$$

Further, from the equations (5) and (6), $P_{wu}=P_{vw}=0$ and the equation (30) can be transformed into the equation (31) as set forth below.

$$P_{z'x'}=0 \quad (31)$$

Subsequently, the moment of inertia $I_x$ of the swash plate 14 with respect to the x-axis of the first rectangular coordinate system, the moment of inertia $I_y$ of the swash plate 14 with respect to the y-axis, and the moment of inertia $I_z$ of the swash plate 14 with respect to the z-axis can be defined by the equations (32) through (34) as set forth below.

$$I_x=\int(y^2+Z^2)dm \quad (32)$$

$$I_y=\int(Z^2+x^2)dm \quad (33)$$

$$I_z=\int(x^2+y^2)dm \tag{34}$$

The product of inertia $P_{xy}$ of the swash plate 14 with respect to a combination of the x-axis and y-axis of the first coordinate system, the product of inertia $P_{yz}$ of the swash plate 14 with respect to a combination of the y-axis and the z-axis, and the product of inertia $P_{zx}$ of the swash plate 14 with respect to a combination of the z-axis and the x-axis can be defined by the equations (35) through (37) as shown below.

$$P_{xy}=\int xydm \tag{35}$$

$$P_{yz}=\int yzdm \tag{36}$$

$$P_{zx}=\int zxdm \tag{37}$$

It should be noted that there is a definite relationship between the first and second rectangular coordinate systems O(x,y,z) and G(x', y', z'). Namely, if the coordinates of the center of gravity G of the swash plate 14 in the first coordinate system O (x,y,z) is defined as ($x_0$, $y_0$, $z_0$), the equations (38) through (40) can be defined as shown below.

$$x=x'+x_0 \tag{38}$$

$$y=y'+y_0 \tag{39}$$

$$z=z' \tag{40}$$

Thus, the equation (32) can be rewritten as the equation (41) as set forth below by introducing the above equations (39) and (40) into the equation (32).

$$\begin{aligned} I_x &= \int\{(y'+y_0)^2+z'^2\}\,dm \\ &= \int(y'^2+2y'y_0+y_0^2+z'^2)\,dm \\ &= \int(y'^2+z'^2)\,dm+y_0^2\int dm+2y_0\int y'dm \end{aligned} \tag{41}$$

Taking the equation (7) into consideration, $\int(y'^2+z'^2)dm$ is equal to $I_{x'}$, $\int dm$ is equal to m, and $y_0\int y'dm$ is equal to 0 ($\int(y'^2+z'^2)dm=I_{x'}$, $\int dm=m$, and $\int y'dm=0$). Thus, the equation (41) can be transformed into the equation (42) as shown below.

$$I_x=I_{x'}+my_0^2 \tag{42}$$

Further, the equation (33) can be rewritten as the equation (43) as set forth below by introducing the above equations (38) and (40) into the equation (33).

$$\begin{aligned} I_y &= \int\{z'^2+(x'+x_0)^2\}\,dm \\ &= \int(z'^2+x'^2+2x'x_0+x_0^2)\,dm \\ &= \int(z'^2+x'^2)\,dm+x_0^2\int dm+2x_0\int x'dm \end{aligned} \tag{43}$$

Taking the equation (8) into consideration, $\int(z'^2+x'^2)dm=I_{y'}$, $\int dm=m$, and $x_0\int x'dm=0$. Therefore, the above equation (43) can be rewritten as the equation (44) as shown below.

$$I_y=I_{y'}+mx_0^2 \tag{44}$$

Further, the equation (34), can be transformed into the equation (45) as set forth below by introducing the equations (38) and (39) into the equation (34) .

$$\begin{aligned} I_z &= \int\{(x'+x_0)^2+(y'+y_0)^2)\,dm \\ &= \int(x'^2+2x'x_0+x_0^2+y'^2+2y'y_0+y_0^2)\,dm \\ &= \int(x'^2+y'^2)\,dm+(x_0^2+y_0^2)\int dm+ \\ &\quad 2x_0\int x'dm+2y_0\int y'dm \end{aligned} \tag{45}$$

Taking the equation (9) into consideration, the following four equations are obtained. Namely, $\int(x'^2+y'^2)dm=I_{z'}$, $\int dm=m$, $x_0\int x'dm=0$, and $y_0\int y'dm=0$. Therefore, the equation (45) can be expressed as the equation (46) as set forth below.

$$I_z=I_{z'}+m(x_0^2+y_0^2) \tag{46}$$

The equation (35) can be transformed into the equation (47) as set forth below by introducing the equations (38) and (39) into the equation (35) .

$$\begin{aligned} P_{xy} &= \int(x'+x_0)(y'+y_0)\,dm \\ &= \int x'y'dm+x_0y_0\int dm+x_0\int y'dm+y_0\int x'dm \end{aligned} \tag{47}$$

Taking the equation (10) into consideration, it can be stated that $\int x'y'dm=P_{x'y'}$, $\int dm=m$, $x_0\int y'dm=0$, and $y_0\int x'dm=0$. Accordingly, the equation (47) can be defined as the equation (48) as shown below.

$$P_{xy}=P_{x'y'}+m\,x_0y_0 \tag{48}$$

Furthermore, the equation (36) can be transformed into the equation (49) as shown below by introducing the equations (39) and (40) into the equation (36).

$$\begin{aligned} P_{yz} &= \int(y'+y_0)\,z'dm \\ &= \int y'z'dm+y_0\int z'dm \end{aligned} \tag{49}$$

At this stage, if the equations (11) and (28) are taken into consideration, it can be seen that $\int y'z'dm=P_{y'z'}=0$, and $y_0\int z'dm=0$. Thus, the equation (49) can be rewritten as the equation (50) as shown below.

$$P_{yz}=0 \tag{50}$$

Further, the equation (37) can be transformed into the equation (51) as set forth below by introducing the equations (38) and (40) into the equation (37).

$$\begin{aligned} P_{zx} &= \int z'(x'+x_0)\,dm \\ &= \int z'x'dm+x_0\int z'dm \end{aligned} \tag{51}$$

Taking the equations (12) and (31) into consideration, $\int z'x'dm=P_{z'x'}=0$, and $x_0\int z'dm=0$. Therefore, the above equation (51) can be rewritten as the equation (52) as set forth below.

$$P_{zx}=0 \tag{52}$$

Thus, the moment of inertia $I_x$, $I_y$, $I_z$ of the swash plate 14 in the first coordinate system O (x, y, z) and the product of inertia $P_{xy}$, $P_{yz}$, $P_{zx}$ of the swash plate 14 in the same first coordinate system are expressed as equations (53) through (58) as shown below with regard to the second rectangular coordinate system G (u,v,w). Namely, from the afore-described equations (42) and (18), $$I_x=I_u\cos^2\Theta+I_v\sin^2\Theta-2P_{uv}\sin\Theta\cos\Theta+my_0^2 \tag{53}$$

From the equations (44) and (21), $$I_y=I_u\sin^2\Theta+I_v\cos^2\Theta-2P_{uv}\sin\Theta\cos\Theta+mx_0^2 \tag{54}$$

From the equations (46) and (23), $$I_z=I_w+m(x_0^2+y_0^2) \tag{55}$$

On the basis of the equations (48) and (25), $$P_{xy}=P_{uv}(\cos^2\Theta-\sin^2\Theta)+(I_u-I_v)\sin\Theta\cos\Theta+mx_0y_0 \tag{56}$$

From the equation (50), $$P_{yz}=0 \tag{57}$$

From the equation (52), $$P_{zx}=0 \quad (58)$$

At this stage, when the swash plate 14 rotates about the y-axis of the first rectangular coordinate system O (x,y,z) (i.e., about the axis of rotation of the drive shaft 6) at a constant angular velocity ω (vector), a moment $M_0$ (vector) acting on the swash plate 14 can be calculated from the equations as set forth below.

It should here be understood that when the internal compressing mechanism of the compressor including the drive shaft 6, the sleeve 12, the rotor 16, the swash plate 14, and other associated elements rotates about the y-axis of the first rectangular coordinate system O (x,y,z) at an angular velocity $\omega y_0$, the components of the above-mentioned vector ω of the angular velocity of the swash plate 14 in the coordinate system O (x,y,z) can be expressed as follows, i.e., $\omega_x=0$, $\omega_y=\omega_{y0}$, and $\omega_z=0$.

First, an angular momentum $H_0$ of the swash plate 14 about the origin O of the first rectangular coordinate system can be obtained by the product of an inertial tensor and the angular velocity ω, and can be expressed by the vector equation (59) as set forth below.

$$H_0=\begin{bmatrix} Ix & -Pxy & -Pxz \\ -Pyx & Iy & -Pyz \\ -Pzx & -Pzy & Iz \end{bmatrix}\begin{bmatrix} 0 \\ \omega y0 \\ 0 \end{bmatrix}=\begin{bmatrix} -Pxy\omega y0 \\ Iy\omega y0 \\ -Pzy\omega y0 \end{bmatrix} \quad (59)$$

At this stage, in the case where the swash plate 14 rotates at a constant angular velocity ω, the moment $M_0$ acting on the swash plate 14 about the origin O of the first rectangular coordinate system due to the unbalance of the swash plate can be obtained as an external product of the angular velocity ω and the angular momentum $H_0$, and can be expressed as the vector equation (60) as set forth below.

$$\begin{aligned} M_0 &= -\omega x H_0 \quad (60) \\ &= -\begin{bmatrix} -Pzy\omega y0^2 \\ 0 \\ Pxy\omega yo^2 \end{bmatrix} \end{aligned}$$

As shown in the equation (57), $P_{zy}=0$. Accordingly, the moment $M_0$ acting on the swash plate 14 and expressed by the above equation (60) can be also expressed by the equation (61) as set forth below.

$$M_0=(0,\ 0,\ -P_{xy}\omega_{y0}^2) \quad (61)$$

The equation (61) indicates that the moment $M_0$ increasing an angle of inclination Θ of the swash plate 14 is a negative moment directed in the negative direction of the z-axis of the first coordinate system.

Therefore, when the swash plate 14 rotates at a constant angular velocity, and when the product of inertia of the swash plate 14 is larger than 0 ($P_{xy}>0$), a moment of inertia for causing an angle of inclination of the swash plate 14 is generated, and when $P_{xy}$ is smaller than 0 ($P_{xy}<0$), a moment causing a reduction of an angle of inclination of the swash plate 14 is generated.

Accordingly, when the swash plate 14 is assembled into a variable capacity swash plate type refrigerant compressor so as to pivotally move between the 0° angular inclination position and a maximum angular inclination position ($\Theta=\Theta_{max}$), and when it is required that the compressor is started with the swash plate set at the 0° angular inclination position, the following conditions (62) and (63) as set forth below must be satisfied.

$$\text{When } \Theta=0,\ P_{xy}>0 \quad (62)$$

$$\text{When } \Theta=\Theta_{max},\ P_{xy}<0 \quad (63)$$

Namely, the shape of the swash plate 14, a relationship between the point O where the plane containing therein the pivotal axis of the swash plate 14 and perpendicular to the axis of rotation of the drive shaft 6 intersects with the axis of rotation of the drive shaft 6 and the center of gravity G of the swash plate 14, and the mass "m" of the swash plate is required to be designed and determined, so that the afore-described equation (56) indicating the product of inertia $P_{xy}$ satisfies the above conditions (62) and (63).

Figure 4:
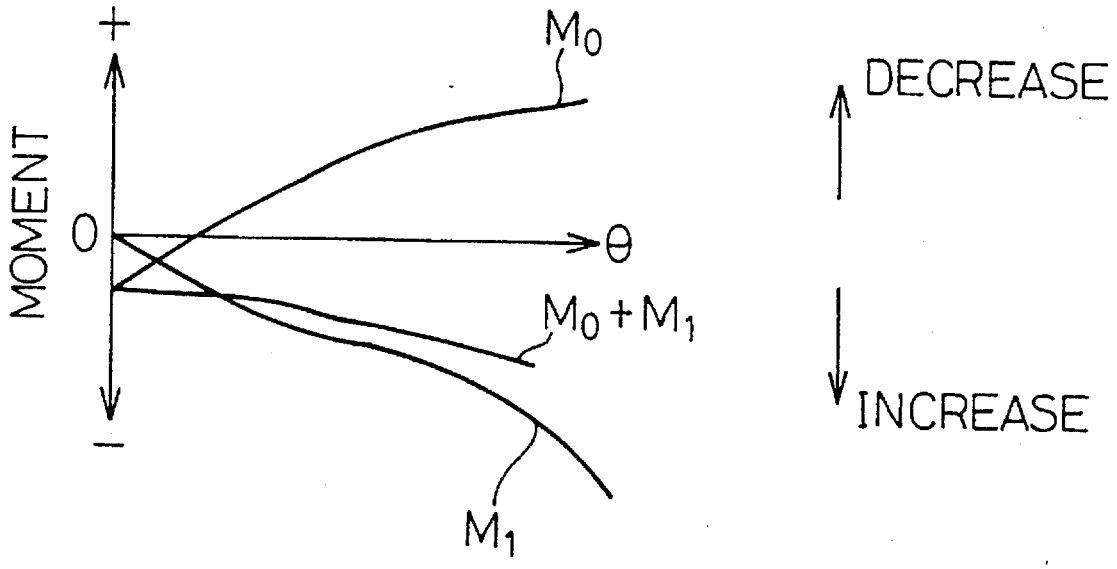

FIG. 4 indicates a graph illustrating a change in a moment generating due to the product of inertia of the swash plate 14 and an angle of inclination Θ of the same swash plate.

In FIG. 4, $M_0$ indicates a moment generated due to the product of inertia $P_{xy}$ of the swash plate 14 determined by the present invention, and $M_1$ is a moment caused by the reciprocating motion of the pistons 10.

It should be understood that when the compressor is started, if the angle of inclination Θ of the swash plate 14 is equal to 0°, the moment $M_1$ is naturally equal to 0 (no moment), and the internal pressures within the compressor are in an equilibrium condition. Thus, the generation of the moment $M_0$ due to the self rotation of the swash plate 14 is an indispensable condition for causing an increase in the angle of inclination of the swash plate 14 from an inclination of 0°.

In the variable capacity swash plate type refrigerant compressor according to the present invention, the minimum angle of inclination of the swash plate with respect to a plane perpendicular to the axis of rotation of the drive shaft can be set at 0°, and the inclination angle of the swash plate can be certainly increased from the minimum inclination angle (0° inclination) to a larger inclination angle. Namely, it is ensured that the discharge capacity of the compressor can be certainly restored to substantially the 0% capacity, to a larger capacity or to the maximum capacity. Therefore, the pressure level in the crank chamber can be prevented from being raised to an unnecessarily high pressure level. Accordingly, the shaft seal device 7c is not subjected to an extremely high pressure, and the durability of the shaft seal device can be increased.

Further, according to the present invention, since the compressor can be operated at a substantially 0% discharge capacity during continuous rotation of the drive shaft, it is possible to omit a solenoid clutch from a drive force transmitting system between a vehicle engine and the compressor. In addition, the possibility of 0% capacity operation of the compressor of the present invention makes it possible to start the compressor at the minimum capacity condition. Thus, the load applied to the vehicle engine upon the start of the compressor can be sufficiently suppressed.

The above-mentioned omission of the solenoid clutch can contribute not only to an improvement in the operation sensed by the driver of the vehicle but also to a reduction in the weight of the compressor or a climate control system or an air-conditioning system mounted on a vehicle, a reduction in the electric power consumption, and a reduction in the fuel consumption of the vehicle.

It should be understood that many variations and modifications will easily occur to persons skilled in the art without departing from the spirit and scope of the invention claimed in the accompanying claims.

We claim:

1. A variable capacity swash plate type refrigerant compressor including:

a housing assembly having a cylinder block, a front housing, and a rear housing; said housing assembly defining therein a suction chamber, a discharge chamber, a crank chamber, and a plurality of cylinder bores;

a plurality of reciprocatory pistons received in said plurality of cylinder bores;

a drive shaft supported in said housing assembly so as to rotate about an axis of rotation thereof upon receipt of a drive force;

a rotor mounted on said drive shaft so as to be rotated together in said crank chamber, said rotor having a guide means disposed in said crank chamber;

a swash plate arranged around said drive shaft in said crank chamber and having a guided means engaged with said guide means of said rotor at a position corresponding to a top dead center of said swash plate so as to be rotated together with said rotor to thereby perform a nutating motion, said swash plate being disposed to be pivoted about a pivoting axis to thereby change an angle of inclination thereof from a plane perpendicular to the axis of rotation of said drive shaft, said pivoting axis of said swash plate being perpendicular to a plane which is defined by said axis of rotation of said drive shaft and said top dead center of said swash plate;

a connecting means for connecting said swash plate to said respective pistons within said crank chamber so that the nutating motion of said swash plate is converted into reciprocating motion of said respective pistons; and a control means for controlling an angle of inclination of said swash plate by adjustably changing a pressure prevailing in said crank chamber to thereby change the capacity of said compressor, wherein said compressor comprises:

means for setting an extent of change in an angle of inclination of said swash plate in such a manner that said swash plate can be pivoted to a 0° inclination position thereof; and means for setting a product of inertia of said swash plate with regard to a rectangular coordinate system having an origin positioned at a crossing point between said axis of rotation of said drive shaft and a plane which is perpendicular to said axis of rotation of said drive shaft and contains therein said pivoting axis of said swash plate, and one of rectangular axes thereof corresponding to said axis of rotation of said drive shaft, said setting of the product of inertia being performed in such a manner that when said angle of inclination of said swash plate is 0°, a moment is generated to increase said angle of inclination of said swash plate to thereby increase the capacity of said compressor in response to the rotation of said swash plate.

2. A variable capacity swash plate type refrigerant compressor according to claim 1, wherein a spring means is provided for constantly urging said swash plate toward said 0° inclination position, a spring force applied by said spring means to said swash plate being set so as to be overcome by said moment produced by said product of inertia of said swash plate even when said swash plate rotates at the slowest possible speed.

3. A variable capacity swash plate type refrigerant compressor according to claim 1, wherein said product of inertia of said swash plate is determined by designing the shape, the position of the center of gravity and the mass, of said swash plate.

4. A variable capacity swash plate type refrigerant compressor according to claim 1, wherein said rotor comprises a pair of support arms provided with a pair of cylindrical through-bores formed therein so as to be used as said guide means, and wherein said swash plate comprises a pair of brackets extending toward said rotor and supporting a pair of ball elements which are formed as said guided means and engaged in said cylindrical through-bores of said rotor.

5. A variable capacity swash plate type refrigerant compressor according to claim 4, wherein said cylindrical through-bores of said rotor and said ball elements of said swash plate are arranged to be circumferentially symmetrical with respect to said axis of rotation of said drive shaft.

6. A variable capacity swash plate type refrigerant compressor according to claim 1, wherein said means for setting an extent of change in an angle of inclination of said swash plate comprises:

a sleeve element slidably mounted on said drive shaft and having a spherical outer surface on which said swash plate is pivotally mounted; and a mechanical stop fixedly mounted on said drive shaft at a position adjacent to one end of said drive shaft, said mechanical stop defining said 0° inclination position of said swash plate when said swash plate abuts against said mechanical stop.

* * * * *

UNITED STATES PATENT AND TRADEMARK OFFICE

CERTIFICATE OF CORRECTION

PATENT NO. : 5,573,379

DATED : November 12, 1996

INVENTOR(S) : Kimura, et al

It is certified that error appears in the above-indentified patent and that said Letters Patent is hereby corrected as shown below:

On the title page:

In item [75], second line, change "Kayukawa Hiroaki" to --Hiroaki Kayukawa--.

Signed and Sealed this

Eleventh Day of February, 1997

*Attest:*

*Attesting Officer*

BRUCE LEHMAN

*Commissioner of Patents and Trademarks*